US010864141B2

(12) United States Patent
Doretti et al.

(10) Patent No.: US 10,864,141 B2
(45) Date of Patent: Dec. 15, 2020

(54) COMBINATION PILL CUTTER AND CRUSHER PLIERS

(71) Applicant: Pharmatools, LLC, Scottsdale, AZ (US)

(72) Inventors: David Doretti, Scottsdale, AZ (US); Ryan Hamblin, Apache Junction, AZ (US)

( * ) Notice: Subject to any disclaimer, the term of this patent is extended or adjusted under 35 U.S.C. 154(b) by 237 days.

(21) Appl. No.: 15/727,372

(22) Filed: Oct. 6, 2017

(65) Prior Publication Data

US 2019/0105231 A1 Apr. 11, 2019

(51) Int. Cl.
*A61J 7/00* (2006.01)

(52) U.S. Cl.
CPC ..... *A61J 7/0007* (2013.01)

(58) Field of Classification Search
CPC ..... A61J 47/0007; A47J 42/22; A47J 42/24; A47J 42/28; A47J 42/32; A47J 42/34; B24D 15/00; B25B 7/00; B25B 3/00; Y10S 241/27
USPC ..... 241/DIG. 27, 168, 169.2; 541/461; 451/461
See application file for complete search history.

(56) References Cited

U.S. PATENT DOCUMENTS 2,070,097 A * 2/1937 Stipe ..... F25C 5/043 241/169
4,815,210 A * 3/1989 Burrage ..... A61B 17/282 30/176
5,025,996 A * 6/1991 Lavin ..... A61J 7/0007 241/168
5,634,272 A * 6/1997 Samuelson ..... A47J 43/26 30/120.2
6,637,683 B1 * 10/2003 (Lomax) Wilbur ... A61J 7/0007 241/101.2
6,637,685 B1 * 10/2003 Kruger ..... A61J 7/0007 241/169.1
7,252,254 B1 8/2007 Engel et al.
7,445,172 B1 * 11/2008 Bucknor ..... A61J 7/0007 241/169
7,699,251 B2 * 4/2010 Frick ..... A61J 7/0007 241/168
2002/0179669 A1 * 12/2002 Buckley ..... A61J 7/0007 225/103

(Continued)

FOREIGN PATENT DOCUMENTS

DE 102009026267 A1 * 2/2011 ..... A61J 7/0007

*Primary Examiner* — Adam J Eiseman
*Assistant Examiner* — Stephen Floyd London
(74) *Attorney, Agent, or Firm* — Keith L. Jenkins, Registered Patent Attorney, LLC; Keith L. Jenkins

(57) ABSTRACT

A pliers having an upper jaw supporting a cutting blade chamber near the tip of the pliers and fixed crushing protrusions closer to a pivot of the pliers. The cutting blade chamber includes a depressed basin with a slot for receiving and retaining a releasable cutting blade. The arcuate concave cutting edge of the blade is aligned to a pill-holding cavity in the lower jaw of the pliers such that, when the pliers are manually closed, the blade cuts an installed pill in half. The fixed crushing protrusions are mounted on a convex semi-cylindrical shell, and are aligned to pill holding cavities in a concave semi-cylindrical crushing basin in the lower jaw of the pliers such that, when the pliers are manually closed, pills in the cavities are crushed.

16 Claims, 8 Drawing Sheets

(56) References Cited

U.S. PATENT DOCUMENTS

| | | | | |
|---|---|---|---|---|
| 2005/0166405 | A1* | 8/2005 | Lai | B26B 13/04 30/229 |
| 2010/0313428 | A1* | 12/2010 | Mocanu | A61B 17/8863 30/193 |
| 2012/0272531 | A1* | 11/2012 | Jordon | B25B 7/02 30/173 |
| 2014/0217221 | A1* | 8/2014 | Hohl | A61J 7/0007 241/285.1 |
| 2016/0184980 | A1* | 6/2016 | Takasaki | B25B 7/02 7/133 |
| 2017/0128324 | A1* | 5/2017 | Muller | B26D 3/30 |
| 2017/0182583 | A1* | 6/2017 | Mizutani | B23K 9/328 |

* cited by examiner

COMBINATION PILL CUTTER AND CRUSHER PLIERS

FIELD OF ART

The present invention relates to pharmaceutical equipment for crushing pills and for cutting pills with the same device. The present invention more particularly relates to a pliers having a removable cutting blade and a multi-chambered pill-crushing apparatus.

BACKGROUND OF THE INVENTION

In the course of preparing pills for ingestion, it may be desirable to lower a dosage by cutting a pill in half. Some pills have grooves that assist in making such cuts. For some patients, pills are too difficult to swallow and so must be crushed before ingestion and, optionally, mixed into food or beverage. Commercially available combination pill cutter and crusher pliers use screw compression for crushing and a hinged blade for cutting using separate parts of a multi-part device for the separate operations. As a result, the commercial devices must be configured one way for crushing and another way for cutting. Commercially available combination pill cutter and crusher pliers have small lever arms for cutting and no handles.

SUMMARY OF THE INVENTION

Briefly described, the invention includes a pliers having an upper jaw supporting a cutting blade chamber near the tip of the pliers and fixed crushing protrusions closer to a pivot of the pliers. The cutting blade chamber includes a depressed basin with a slot for receiving and retaining a releasable cutting blade. The concave arcuate cutting edge of the blade is aligned to a pill-holding cavity in the lower jaw of the pliers such that, when the pliers are manually closed, the blade cuts an installed pill in half. The fixed crushing protrusions are mounted on a convex semi-cylindrical shell, and are aligned to pill holding cavities in a concave semi-cylindrical crushing basin in the lower jaw of the pliers such that, when the pliers are manually closed, pills in the cavities are crushed.

In an embodiment, a combination pill cutter and crusher pliers including: a lower handle and an upper handle, the upper handle and the lower handle joined at a pivot; an upper jaw of one piece with the lower handle; a lower jaw of one piece with the upper handle; a crushing basin in the lower jaw; and a cutting basin in the lower jaw. That pliers, including a plurality of pill sockets in the crushing basin. That pliers, where the plurality of pill sockets are of various sizes. That pliers, including a convex oval pill socket in the cutting basin. That pliers, including a crusher support in the upper jaw adaptively shaped, sized, and aligned to the crushing basin. That pliers, including a plurality of pill crusher protrusions extending from the crusher support and aligned, shaped, and sized adaptive to a plurality of pill sockets in the crushing basin. That pliers, including a blade cavity in the upper jaw adaptively shaped, sized and aligned to the cutting basin. That pliers, including a slot in the blade cavity aligned to the pill socket in the cutter basin. That pliers, including a pill-cutting blade adapted to be inserted in the slot. That pliers, including an arcuate concave cutting edge on the pill-cutting blade.

In an embodiment, a combination pill cutter and crusher pliers including: a lower handle and an upper handle, the upper handle and the lower handle joined at a pivot; an upper jaw of one piece with the lower handle; a lower jaw of one piece with the upper handle; a crushing basin in the lower jaw proximate the pivot; a cutting basin in the lower jaw distal the pivot; a blade cavity in the upper jaw adaptively shaped, sized and corresponding to the cutting basin; and a crusher support in the upper jaw adaptively shaped, sized and corresponding to the crushing basin. That pliers, including a plurality of pill sockets in the crushing basin. That pliers, where the plurality of pill sockets are of various sizes. That pliers, including a convex oval pill socket in the cutting basin. That pliers, including: a crusher support in the upper jaw adaptively shaped, sized and corresponding to the crushing basin; and a plurality of pill crusher protrusions extending from the crusher support and aligned, shaped, and sized corresponding to a plurality of pill sockets in the crushing basin. That pliers, including a slot in the blade cavity corresponding to the pill socket in the cutter basin. That pliers, including a pill-cutting blade adapted to be inserted in the slot. That pliers, including an arcuate concave cutting edge on the pill-cutting blade.

In an embodiment, a combination pill cutter and crusher pliers including: a lower handle and an upper handle, the upper handle and the lower handle joined at a pivot; an upper jaw of one piece with the lower handle; a lower jaw of one piece with the upper handle; a crushing basin in the lower jaw proximate the pivot; a cutting basin in the lower jaw distal the pivot; a plurality of pill sockets in the crushing basin, where the plurality of pill sockets are of various sizes; a convex oval pill socket in the cutting basin; a crusher support in the upper jaw adaptively shaped, sized and corresponding to the crushing basin; a plurality of pill crusher protrusions extending from the crusher support and aligned, shaped, and sized corresponding to a plurality of pill sockets in the crushing basin; a blade cavity in the lower jaw adaptively shaped, sized and corresponding to the cutting basin; and a crusher support in the upper jaw adaptively shaped, sized and corresponding to the crushing basin. That pliers, including: a slot in the blade cavity aligned to the pill socket in the cutter basin; a pill-cutting blade adapted to be inserted in the slot; an arcuate concave cutting edge on the pill-cutting blade.

DESCRIPTION OF THE FIGURES OF THE DRAWINGS

The present invention will hereinafter be described in conjunction with the following drawing figures, wherein like numerals denote like elements.

DETAILED DESCRIPTION OF THE INVENTION

Figure 2:
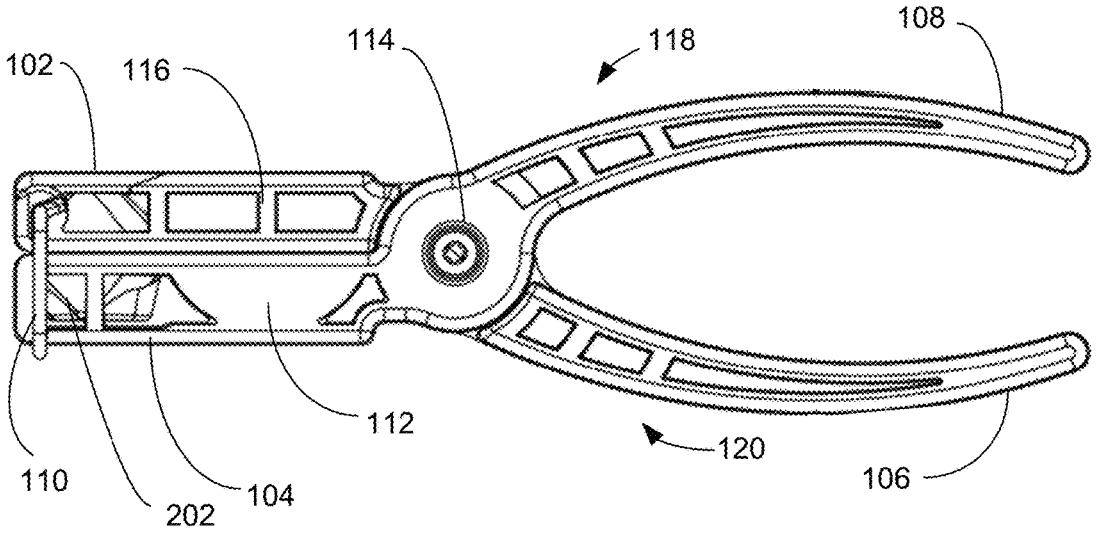
FIG. 2 is a side elevation view illustrating the exemplary embodiment of the combination pill cutter and crusher pliers of FIG. 1, according to a preferred embodiment of the present invention.

As used and defined herein, direction words such "upper", "lower", "top", "bottom", "front", "rear" etc. are referenced to the device in its operational orientation, as shown in FIG. 2.

Figure 1:
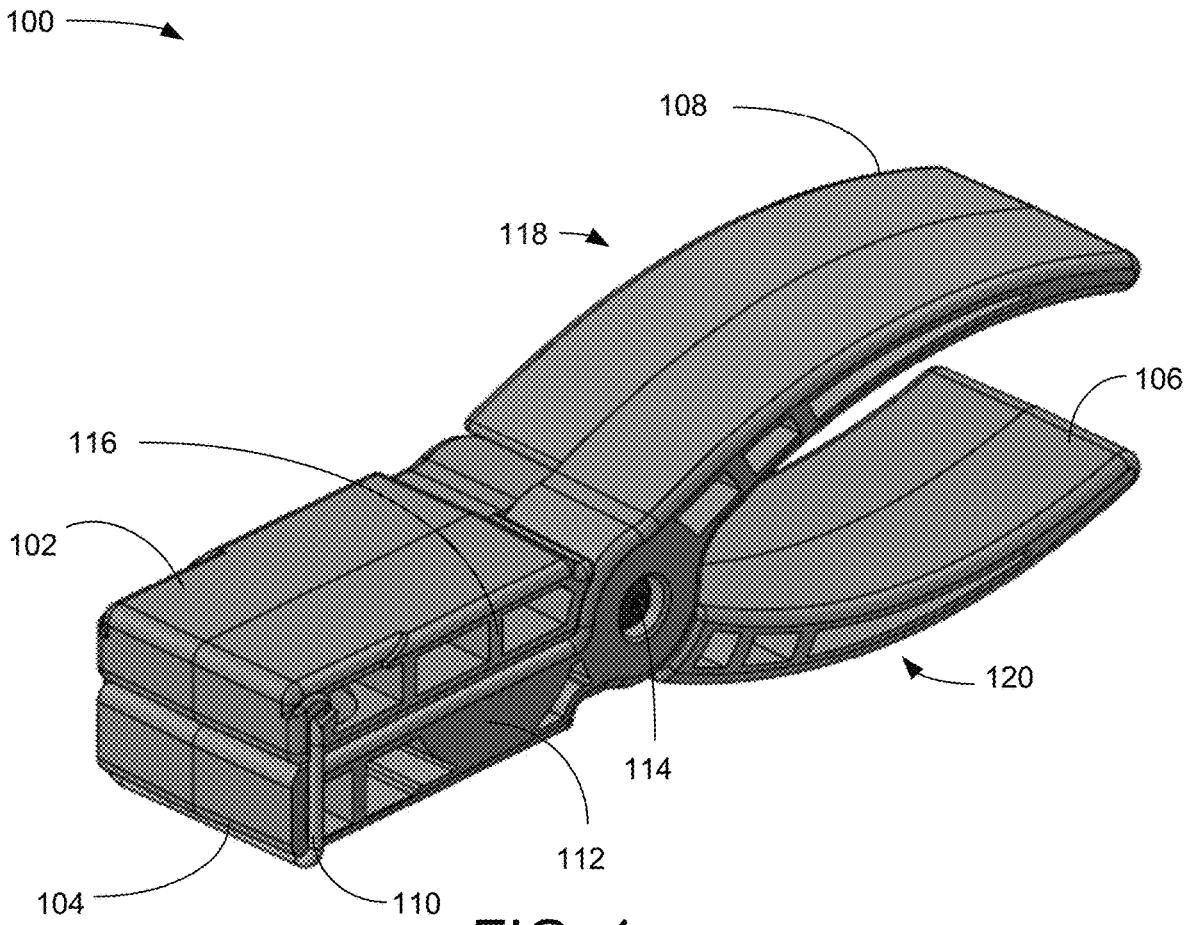
FIG. 1 is a front top perspective view illustrating an exemplary embodiment of the combination pill cutter and crusher pliers, according to a preferred embodiment of the present invention.

FIG. 1 is a front top perspective view illustrating an exemplary embodiment of the combination pill cutter and crusher pliers 100, according to a preferred embodiment of the present invention. Combination pill cutter and crusher pliers 100 has an upper handle 108 that is of one piece 118 with lower jaw 104 and a lower handle 106 that is of one piece 120 with upper jaw 102. First and second pieces 118 and 120 are joined with a pivot 114. Rather than being solid, each piece 118, 120 uses bracing structures 116 (one of seven labeled) to provide adequate structural strength with less weight than a solid piece. The pivot 114 is torsionally biased to open the jaws 102 and 104 when no force is applied to the handles 108 and 106. Lock 110 is shown in the locked position to keep jaws 102 and 104 closed when the combination pill cutter and crusher pliers 100 is not in use. The exterior of crushing basin 112 can be seen. The advantage of this design is that the handles allow the application of more force for crushing and for cutting.

FIG. 2 is a side elevation view illustrating the exemplary embodiment of the combination pill cutter and crusher pliers 100 of FIG. 1, according to a preferred embodiment of the present invention. An exterior surface of cutting basin 202 can be seen. Combination pill cutter and crusher pliers 100 is preferably made of injection molded hard plastic. In various embodiments, other materials of similar strength and hardness may be used. Preferably, the material used is chemically inert as far as pharmaceuticals are concerned. In other embodiments, the material used may be metal or composite.

Figure 3:
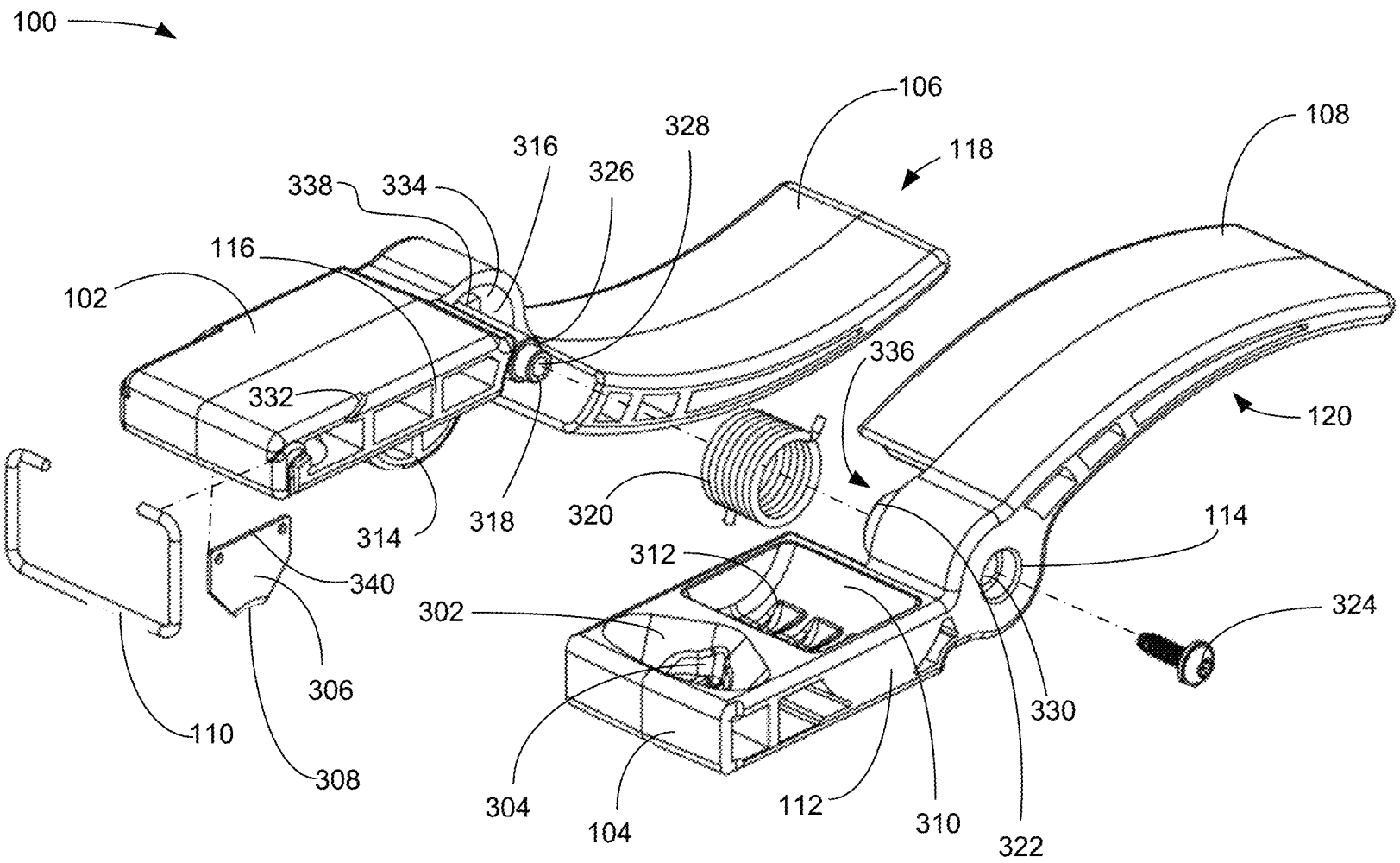
FIG. 3 is an exploded front top perspective view illustrating the exemplary embodiment of the combination pill cutter and crusher pliers of FIG. 1, according to a preferred embodiment of the present invention.

FIG. 3 is an exploded front top perspective view illustrating the exemplary embodiment of the combination pill cutter and crusher pliers 100 of FIG. 1, according to a preferred embodiment of the present invention. Lock 110, when not in use, rotates over upper jaw 102 and releasably snaps into grooves 332 (one of two labeled). Cutting blade 306 with cutting edge 308 may be inserted into upper jaw 102 and may be removed for cleaning or replacement. Cutting blade 306 has a base 340. The crusher support 314 is conformally shaped to, and is positioned to correspond to, the internal surface 310 of crusher basin 112 in the lower jaw 104.

Pivot barrel 316 extends transversely through torsion spring 320. Blocks 338 (one of two visible in this view) within pivot cavities 334 and 336 prevent rotation of the torsion spring 320. Pivot barrel 316 has a shoulder 326 and an extension 318 of smaller radius into which is tapped a threaded bore 328. Pivot barrel 316 is received through lower jaw pivot shoulder 322 with the pivot barrel shoulder 326 abutting inner restriction 330. Screw 324 is then threaded into threaded bore 328 to complete assembly. Crusher basin 112 in lower jaw 104 is shown with a plurality of pill sockets 312 (one of three labeled), enabling multiple pills to be crushed simultaneously. In a particular embodiment, pill sockets 312 may be of various sizes to accommodate pills of various sizes. Cutting basin 302 can be seen in lower jaw 104 with pill socket 304 therein.

Figure 4:
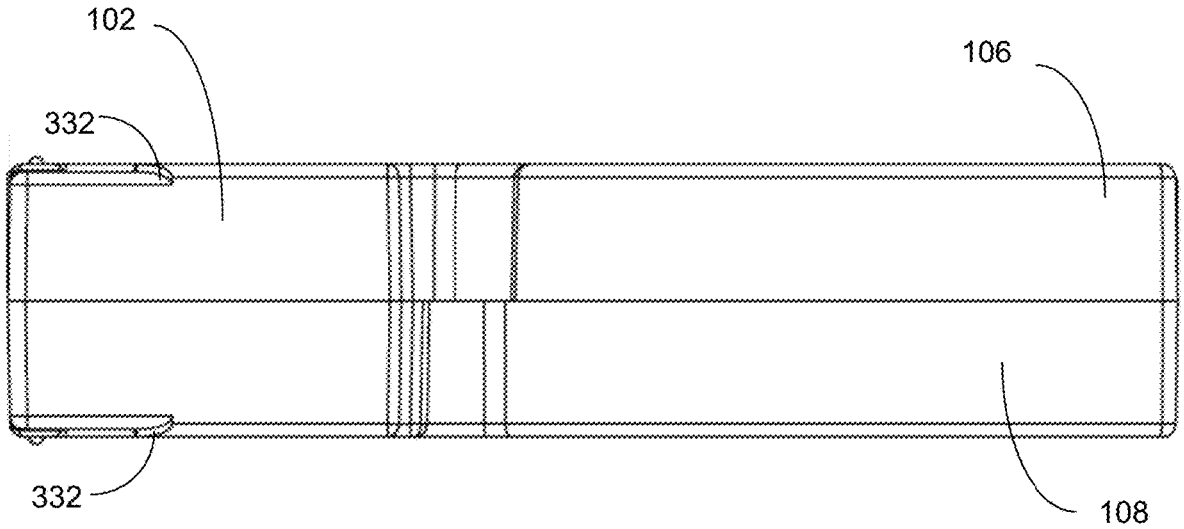
FIG. 4 is a top plan view illustrating the exemplary embodiment of the combination pill cutter and crusher pliers of FIG. 1, according to a preferred embodiment of the present invention.

FIG. 4 is a top plan view illustrating the exemplary embodiment of the combination pill cutter and crusher pliers 100 of FIG. 1, according to a preferred embodiment of the present invention. Grooves 332 can be more clearly seen in this view. Compactness of design is an advantage of this invention.

Figure 5:
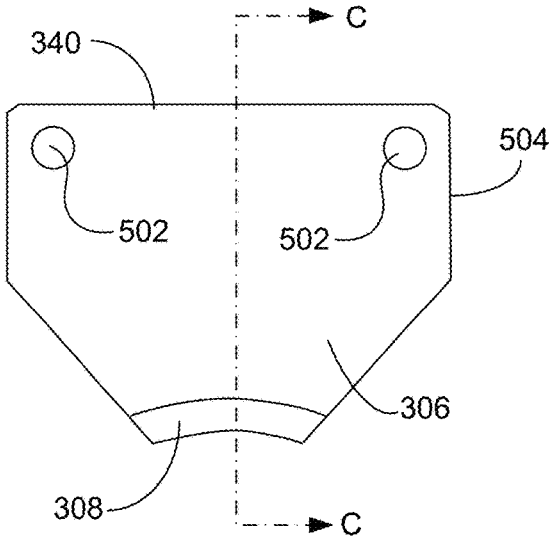
FIG. 5 is a front elevation view illustrating an exemplary blade of the exemplary embodiment of the combination pill cutter and crusher pliers of FIG. 1 and defining cross section CC, according to a preferred embodiment of the present invention.

FIG. 5 is a front elevation view illustrating an exemplary blade 306 of the exemplary embodiment of the combination pill cutter and crusher pliers 100 of FIG. 1, according to a preferred embodiment of the present invention. Holes 502 receive alignable protrusions 1502 (see FIG. 15) inside the blade-receiving slot 904, (see FIG. 9) to hold the blade 306 in place against the pull of gravity. Sides 504 (one of two labeled) preferably extend from the base 340 the same length as the depth of blade-receiving slot 904 (see FIG. 9). Blade 306 is preferably made of stainless steel. Cutting edge 308 is arcuate and concave. The advantage of the arcuate concave cutting edge 308 is that the pill is cut inward from opposite sides, which produces a more exact cut. A single flat blade relies on initiating crack propagation from one point, which is less precise.

Figure 6:
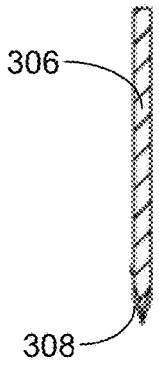
FIG. 6 is a side elevation view through cross section CC illustrating an exemplary blade of the exemplary embodiment of the combination pill cutter and crusher pliers of FIG. 1, according to a preferred embodiment of the present invention.

FIG. 6 is a side elevation view illustrating the exemplary blade 306 of the exemplary embodiment of the combination pill cutter and crusher pliers 100 of FIG. 1, according to a preferred embodiment of the present invention. A thirty degree angle on the cutting edge 308 is preferred, but not limiting.

Figure 7:
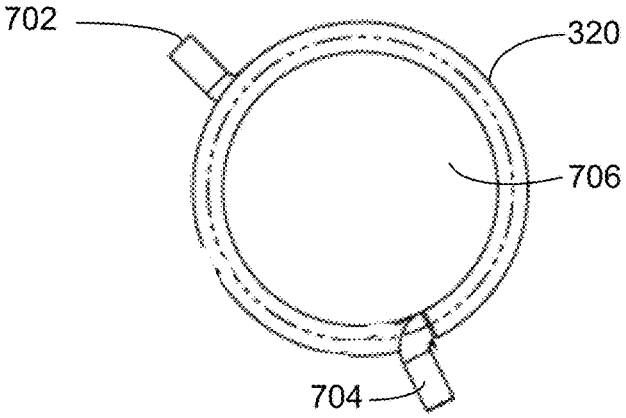
FIG. 7 is an end view illustrating an exemplary torsion spring of the exemplary embodiment of the combination pill cutter and crusher pliers of FIG. 1, according to a preferred embodiment of the present invention.

FIG. 7 is an end view illustrating an exemplary torsion spring 320 of the exemplary embodiment of the combination pill cutter and crusher pliers 100 of FIG. 1, according to a preferred embodiment of the present invention. Torsional spring 320 is preferably a coil spring with extending ends 702 and 704 which engage blocks 338 within the pivot cavities 334 and 336 to prevent rotation of the torsion spring 320. Empty interior 706 receives pivot barrel 316 during installation.

Figure 8:
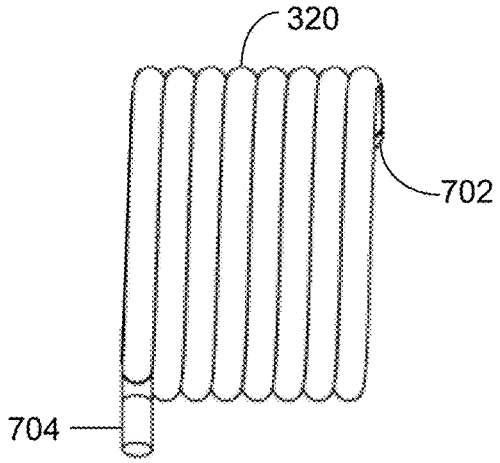
FIG. 8 is an end view illustrating an exemplary torsion spring of the exemplary embodiment of the combination pill cutter and crusher pliers of FIG. 1, according to a preferred embodiment of the present invention.

FIG. 8 is an end view illustrating the exemplary torsion spring 320 of the exemplary embodiment of the combination pill cutter and crusher pliers 100 of FIG. 1, according to a preferred embodiment of the present invention. The number of windings shown are merely exemplary. In various embodiments, various torsion springs 320, including various types of torsion springs 320, may be used.

Figure 9:
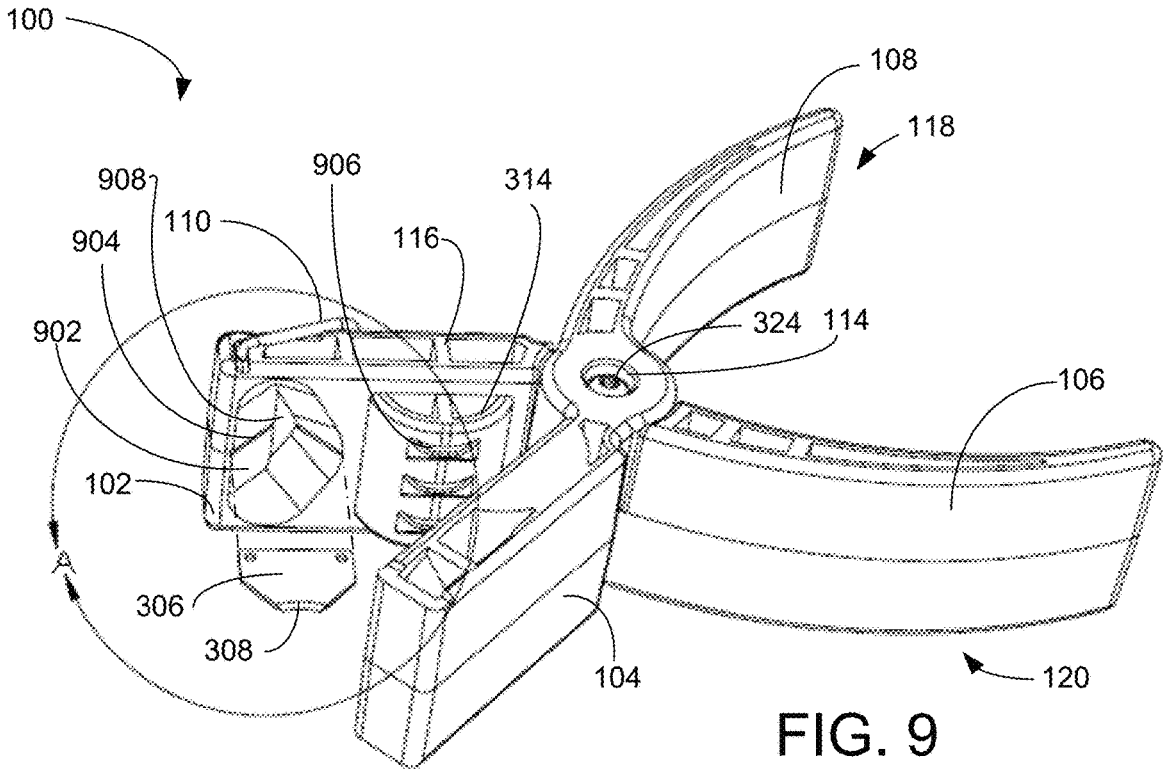
FIG. 9 is a side bottom perspective view illustrating the exemplary embodiment of the combination pill cutter and crusher pliers of FIG. 1 and defining detail A, according to a preferred embodiment of the present invention.

FIG. 9 is a side bottom perspective view illustrating the exemplary embodiment of the combination pill cutter and crusher pliers 100 of FIG. 1 and defining detail A, according to a preferred embodiment of the present invention. Jaws 102 and 104 are shown biased open by torsion spring 320. Pill crusher protrusions 906 (one of three labeled) extending radially outward from crusher support 314 are sized, shaped, and positioned to correspond to pill sockets 312. Blade cavity 902 includes blade slot 904 in two portions for receiving and retaining blade 306 with arcuate concave cutting edge 308 facing downward.

Figure 10:
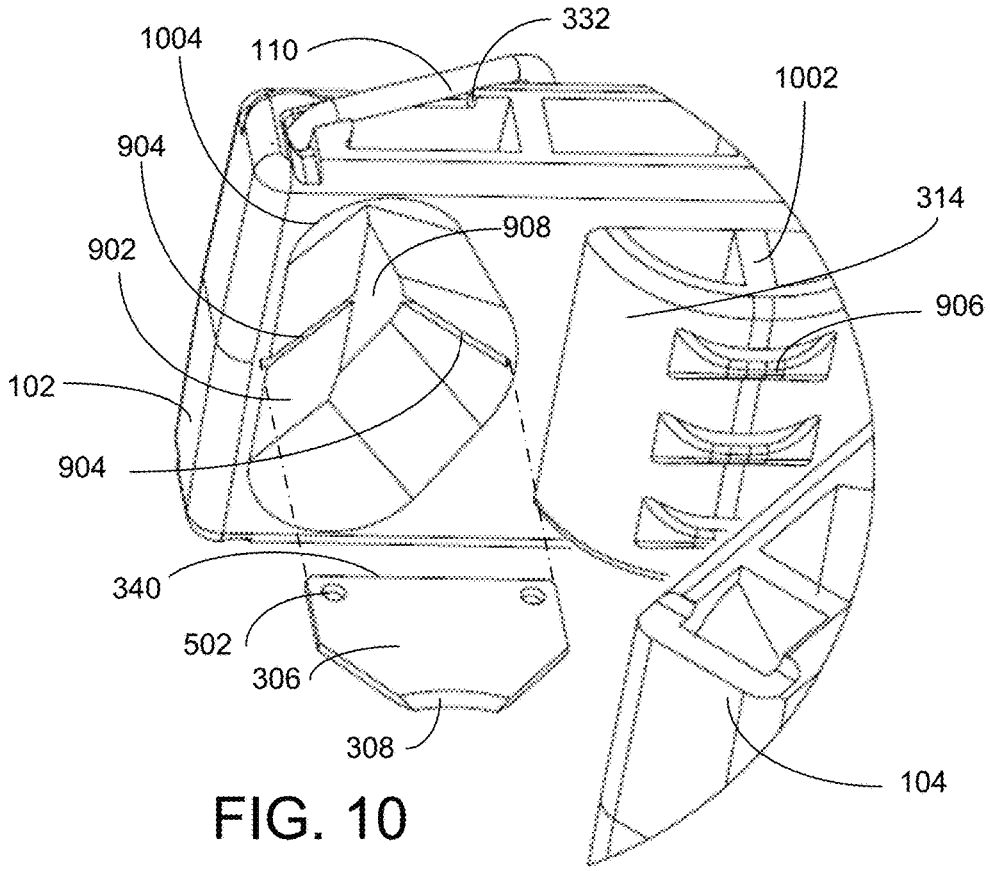
FIG. 10 is a side bottom perspective view of detail A illustrating the exemplary embodiment of the combination pill cutter and crusher pliers of FIG. 1, according to a preferred embodiment of the present invention.

FIG. 10 is a side bottom perspective view of detail A illustrating the exemplary embodiment of the combination pill cutter and crusher pliers 100 of FIG. 1, according to a preferred embodiment of the present invention. Lock 110 is shown stowed in grooves 332. Blade slot 904 has two portions aligned on opposing front and back sides of blade cavity 902. Crusher support 314 has an internal apex brace 1002. Blade cavity 902 has a rounded triangular perimeter 1004 and a flat bottom 908. In various embodiments, blade cavity 902 may have perimeters 1004 of various respective shapes, within the functional constraints of the present invention.

Figure 11:
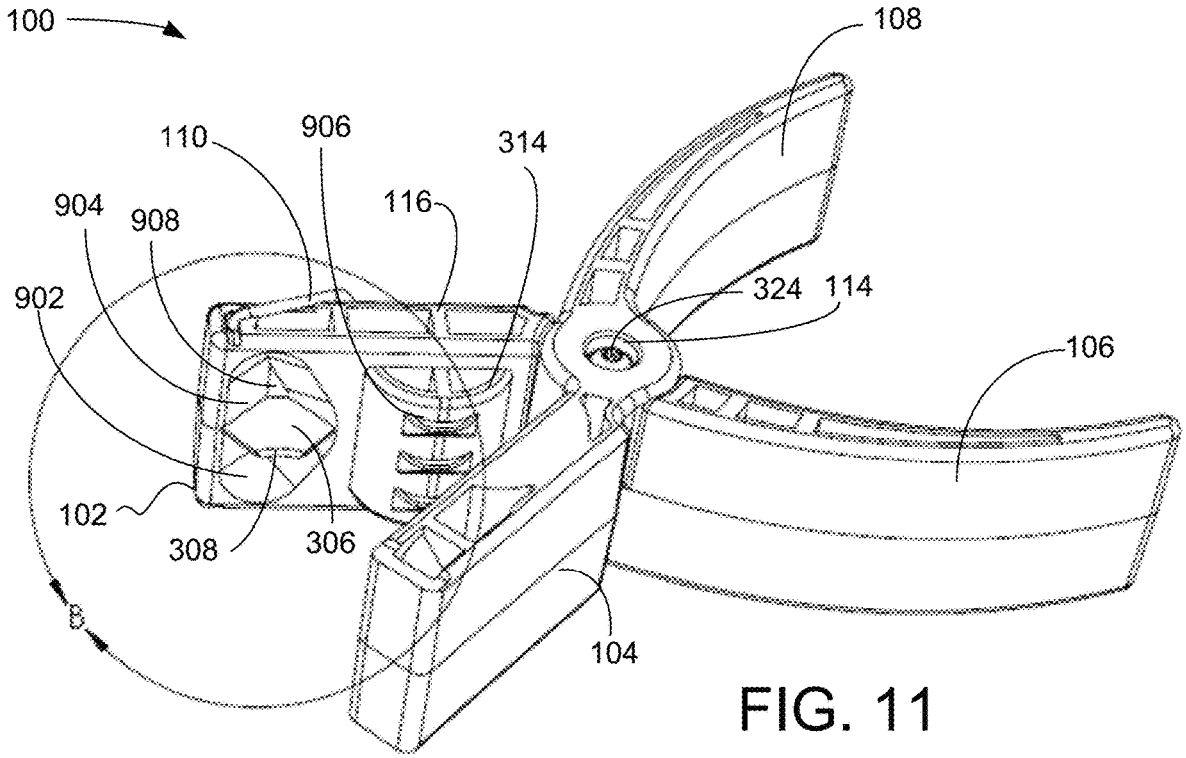
FIG. 11 is a side bottom perspective view illustrating the exemplary embodiment of the combination pill cutter and crusher pliers of FIG. 1 and defining detail B, according to a preferred embodiment of the present invention.

FIG. 11 is a side bottom perspective view illustrating the exemplary embodiment of the combination pill cutter and crusher pliers 100 of FIG. 1 and defining detail B, according to a preferred embodiment of the present invention. The blade 306 is installed in the slot 904 in the blade cavity 902. Base 340 of blade 306 rests on the flat bottom 908 of blade cavity 902. Jaws 102 and 104 are shown biased open by torsion spring 320.

Figure 12:
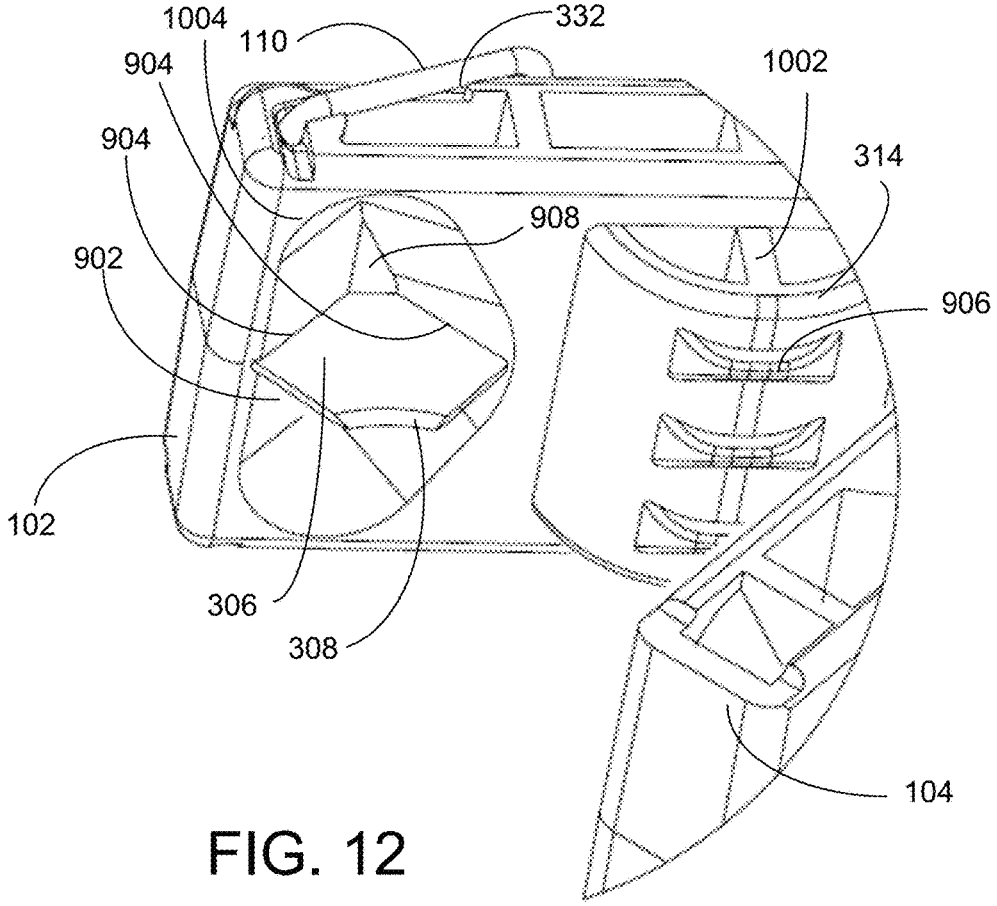
FIG. 12 is a side bottom perspective view of detail B illustrating the exemplary embodiment of the combination pill cutter and crusher pliers of FIG. 1, according to a preferred embodiment of the present invention.

FIG. 12 is a side bottom perspective view of detail B illustrating the exemplary embodiment of the combination pill cutter and crusher pliers 100 of FIG. 1, according to a preferred embodiment of the present invention. Preferably, the sides 504 of cutting blade 306 extend from base 340 the same distance as the slot 904 is deep, as shown.

Figure 13:
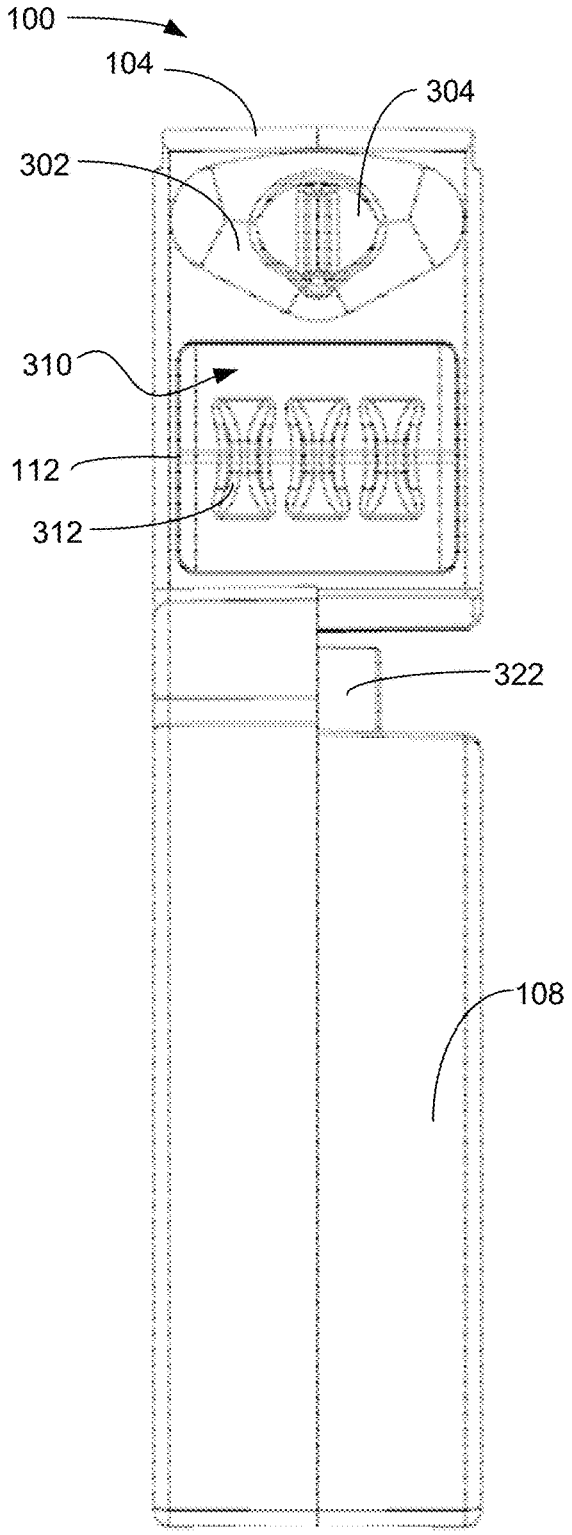
FIG. 13 is a top plan view illustrating an exemplary lower jaw of the exemplary embodiment of the combination pill cutter and crusher pliers of FIG. 1, according to a preferred embodiment of the present invention.

FIG. 13 is a top plan view illustrating an exemplary lower jaw 104 of the exemplary embodiment of the combination pill cutter and crusher pliers 100 of FIG. 1, according to a preferred embodiment of the present invention. The rounded triangular cutting basin 302 is preferably forward of crushing basin 112, but that is not a limitation of the invention. Pill socket 304 is oval shaped and concave to hold various sizes of pills with their respective middle portions corresponding to cutting blade 306. Cutting basin 302 provides space for pill halves when cut. Crushing basin 302 provides room for pill powder when crushed. Preferably, crushing basin 112 contains three pill sockets 312. In other embodiments, more or one fewer pill sockets may be used. The illustrated shapes are preferred, but are not a limitation of the invention. In various embodiments, pill sockets 312 may be of various respective sizes corresponding to pills of various sizes.

Figure 14:
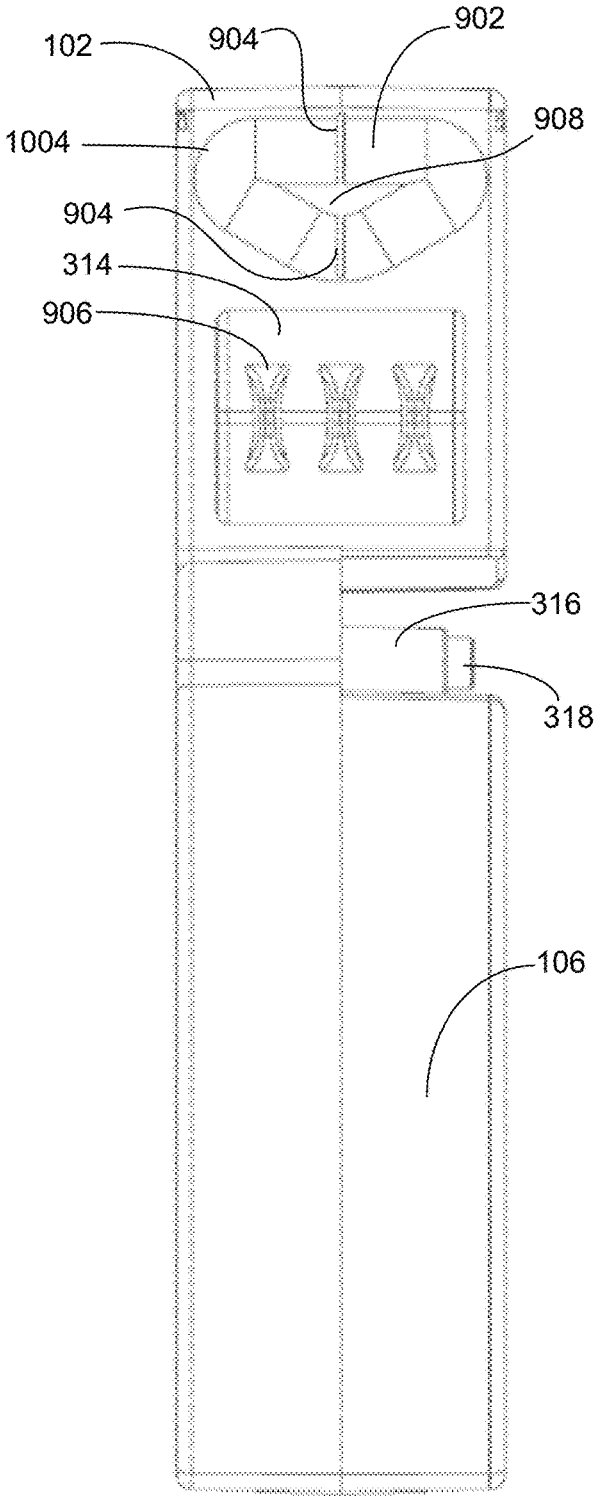
FIG. 14 is a bottom plan view illustrating an exemplary upper jaw of the exemplary embodiment of the combination pill cutter and crusher pliers of FIG. 1, according to a preferred embodiment of the present invention.

FIG. 14 is a bottom plan view illustrating an exemplary upper jaw 102 of the exemplary embodiment of the combination pill cutter and crusher pliers 100 of FIG. 1, according to a preferred embodiment of the present invention. Blade cavity 902 has a rounded triangular perimeter 1004 with an approximately triangular flat bottom 908. Slot 904 receives and retains blade 306. In operation, the cutting edge 308 aligns to the middle of pill socket 304 when the jaws 102 and 104 are closed and to a pill installed therein when the jaws 102 and 104 are closed. Pill crusher protrusions 906 (one of three labeled) extend from crusher support 314 and are positioned to corresponding pill sockets 312. Pill crusher protrusions 906 are slightly smaller than pill sockets 312. The shapes and sizes of pill crusher protrusions 906 (one of three labeled) and corresponding pill sockets 312 may vary within the constraint that the sizes and shapes of protrusions 906 correspond with pill sockets 312.

In operation, the combination pill cutter and crusher pliers 100 may cut and crush different pills in the same operation; may only crush one, two or three pills; or may only cut one pill, depending on what the user desires. The combination pill cutter and crusher pliers 100 is manually operated by inserting a pill or pills and squeezing handles 106 and 108 together. The ability to crush multiple pills at one time saves time for the user, and is an advantage of the present invention.

Figure 15:
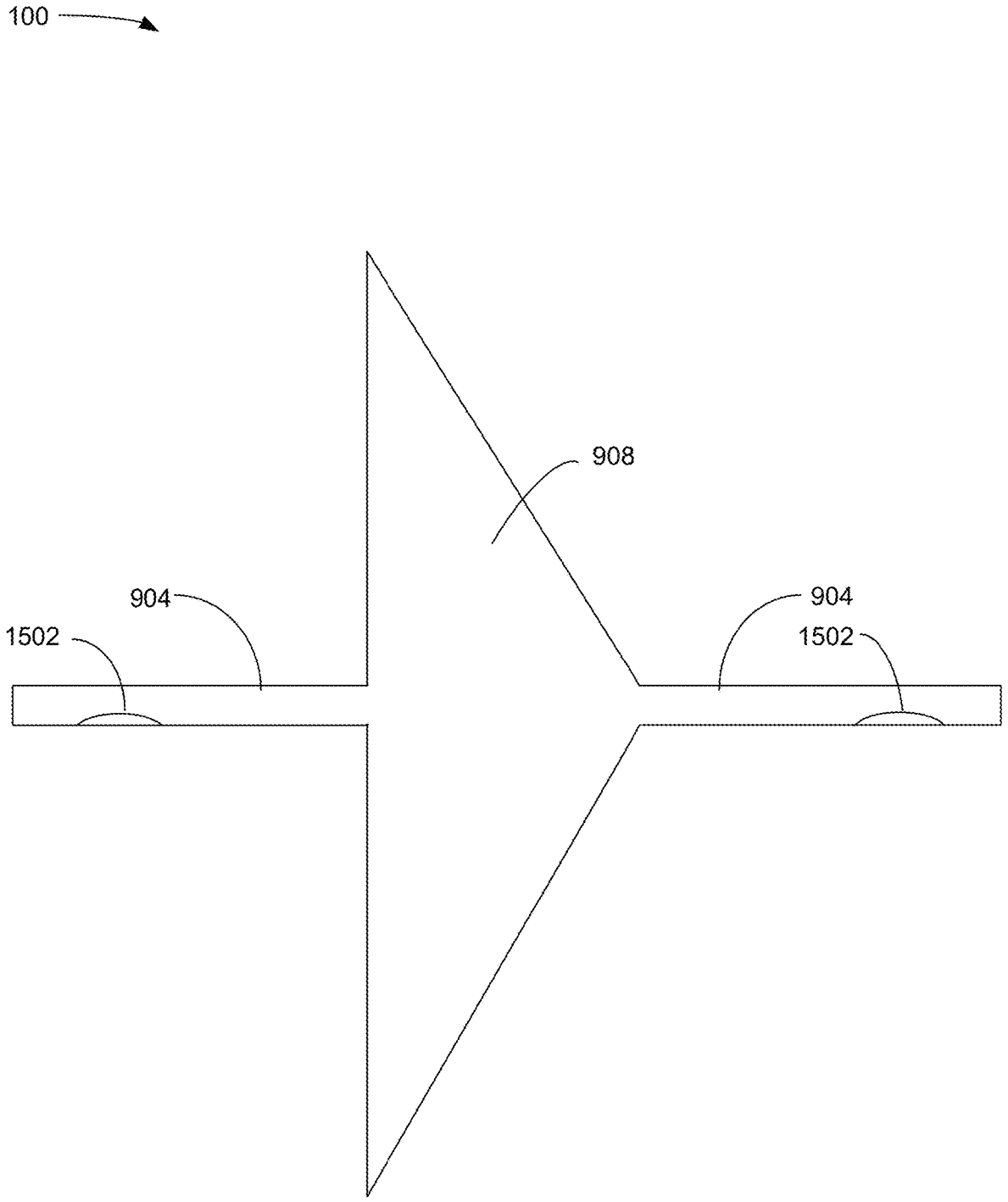
FIG. 15 is a top plan view illustrating an exemplary blade slot and flat bottom of the blade cavity of the exemplary embodiment of the combination pill cutter and crusher pliers 100 of FIG. 1, according to a preferred embodiment of the present invention.

FIG. 15 is a top plan view illustrating an exemplary blade slot and flat bottom of the blade cavity of the exemplary embodiment of the combination pill cutter and crusher pliers 100 of FIG. 1, according to a preferred embodiment of the present invention. Slot 904 retains blade 306 using bumps 1502 (not to scale) that engage holes 502 in blade 306 when blade 306 is inserted into slot 904. The base 340 of blade 306 rests on the portion of flat bottom 908 between slot portions 904 when blade 306 is installed. In various embodiments, various other configurations of bumps 1502 may be used.

We claim:

1. A combination cutter and crusher pliers for medicinal pills for humans comprising:

a. a lower handle and an upper handle, said upper handle and said lower handle joined at a pivot;

b. an upper jaw of one piece with said lower handle;

c. a lower jaw of one piece with said upper handle;

d. a semi-cylindrical crushing basin, further comprising a plurality of spaced-apart and discrete medicinal pill sockets, adapted to receive at least one medicinal pill of said medicinal pills for crushing into powder, in said lower jaw, wherein i. said plurality of spaced-apart and discrete medicinal pill sockets in said semi-cylindrical crushing basin comprises a linear, side-by-side array of said plurality of spaced-apart and discrete medicinal pill sockets; and ii. said semi-cylindrical crushing basin comprises an inner surface of a longitudinal half of a right circular cylinder shell;

e. a cutting basin, further comprising a concave oval pill socket, adapted to receive a medicinal pill of said medicinal pills for cutting in half, in said lower jaw;

f. wherein said semi-cylindrical crushing basin is configured to retain said at least one said medicinal pill after said at least one medicinal pill is crushed; and g. wherein said cutting basin is configured to retain first and second cut halves of said medicinal pill after said medicinal pill is cut.

2. The pliers of claim 1, wherein said plurality of spaced-apart and discrete medicinal pill sockets are various sizes.

3. The pliers of claim 1, comprising a semi-cylindrical crusher support in said upper jaw complementarily shaped, sized, and aligned to said semi-cylindrical crushing basin and said plurality of spaced-apart and discrete medicinal pill sockets.

4. The pliers of claim 3, comprising a plurality of medicinal pill crusher protrusions extending from said crusher support and aligned, shaped, and sized to be received by said plurality of spaced-apart and discrete medicinal pill sockets in said semi-cylindrical crushing basin.

5. The pliers of claim 1, comprising a blade cavity in said upper jaw complementarily shaped, sized and aligned to said cutting basin and said concave oval pill socket.

6. The pliers of claim 5, comprising a slot in said blade cavity aligned to said concave oval pill socket in said cutting basin.

7. The pliers of claim 6, comprising a flat pill-cutting blade adapted to be inserted in said slot.

8. The pliers of claim 7, comprising an arcuate cutting edge, concave in a geometric plane of said flat pill-cutting blade.

9. A combination cutter and crusher pliers for medicinal pills for humans comprising:

a. a lower handle and an upper handle, said upper handle and said lower handle joined at a pivot;

b. an upper jaw of one piece with said lower handle;

c. a lower jaw of one piece with said upper handle;

d. a semi-cylindrical crushing basin, further comprising a plurality of spaced-apart and discrete medicinal pill sockets, adapted to receive at least one medicinal pill of said medicinal pills for crushing into powder, in said lower jaw proximate said pivot, wherein i. said plurality of spaced-apart and discrete medicinal pill sockets in said semi-cylindrical crushing basin comprises a linear, side-by-side array of said plurality of spaced-apart and discrete medicinal pill sockets; and ii. said semi-cylindrical crushing basin comprises an inner surface of a longitudinal half of a right circular cylinder shell;

e. a cutting basin, further comprising a concave oval pill socket, adapted to receive a medicinal pill of said medicinal pills for cutting in half, in said lower jaw distal said pivot;

f. a blade cavity in said upper jaw complementarily shaped, sized and corresponding to said cutting basin and said concave oval pill socket; and g. a semi-cylindrical crusher support in said upper jaw complementarily shaped, sized and corresponding to said semi-cylindrical crushing basin and said plurality of spaced-apart and discrete medicinal pill sockets;

h. wherein said semi-cylindrical crushing basin is configured to retain said at least one said medicinal pill after said at least one medicinal pill is crushed; and i. wherein said cutting basin is configured to retain first and second cut halves of said medicinal pill after said medicinal pill is cut.

10. The pliers of claim 9, wherein said plurality of spaced-apart and discrete medicinal pill sockets are of various sizes.

11. The pliers of claim 9, comprising a plurality of medicinal pill crusher protrusions extending from said crusher support and aligned, shaped, and sized corresponding to said plurality of spaced-apart and discrete medicinal pill sockets in said semi-cylindrical crushing basin.

12. The pliers of claim 9, comprising a slot in said blade cavity corresponding to said oval concave pill socket in said cutting basin.

13. The pliers of claim 12, comprising a flat pill-cutting blade adapted to be inserted in said slot.

14. The pliers of claim 13, comprising an arcuate cutting edge, concave in a geometric plane of said flat pill-cutting blade.

15. A combination cutter and crusher pliers for medicinal pills for humans comprising:

a. a lower handle and an upper handle, said upper handle and said lower handle joined at a pivot;

b. an upper jaw of one piece with said lower handle;

c. a lower jaw of one piece with said upper handle;

d. a semi-cylindrical crushing basin, further comprising a plurality of spaced-apart and discrete medicinal pill sockets, adapted to receive at least one medicinal pill of said medicinal pills for crushing into powder, in said lower jaw proximate said pivot, wherein i. said plurality of spaced-apart and discrete medicinal pill sockets in said semi-cylindrical crushing basin comprises a linear, side-by-side array of said plurality of spaced-apart and discrete medicinal pill sockets, and ii. said semi-cylindrical crushing basin comprises an inner surface of a longitudinal half of a right circular cylinder shell;

e. a cutting basin, adapted to receive a medicinal pill of said medicinal pills for cutting in half, in said lower jaw distal said pivot;

f. wherein said plurality of spaced-apart and discrete medicinal pill sockets are of various sizes;

g. a concave oval pill socket in said cutting basin;

h. a semi-cylindrical crusher support in said upper jaw complementarily shaped, sized and corresponding to said semi-cylindrical crushing basin and said plurality of spaced-apart and discrete medicinal pill sockets;

i. a plurality of medicinal pill crusher protrusions extending from said semi-cylindrical crusher support and aligned, shaped, and sized corresponding to said plurality of spaced-apart and discrete medicinal pill sockets in said semi-cylindrical crushing basin; and j. a blade cavity in said upper jaw adaptively shaped, sized and corresponding to said cutting basin and said concave oval pill socket;

k. wherein said semi-cylindrical crushing basin is configured to retain said at least one said medicinal pill after said at least one medicinal pill is crushed; and l. wherein said cutting basin is configured to retain first and second cut halves of said medicinal pill after said medicinal pill is cut.

16. The pliers of claim 15, comprising:

a. a slot in said blade cavity aligned to said oval concave pill socket in said cutting basin;

b. a flat pill-cutting blade adapted to be inserted in said slot;

c. an arcuate cutting edge of said blade, concave in a geometric plane of said flat pill-cutting blade.

* * * * *